United States Patent [19]

Delobel et al.

[11] Patent Number: 4,663,928

[45] Date of Patent: May 12, 1987

[54] MACHINE FOR WINDING ON A CABLE, WITH A VERY SHORT PITCH, AT LEAST ONE METAL SHEATHING WIRE

[75] Inventors: Gérard Delobel, Calais; Daniel Paulin, Paris, both of France

[73] Assignee: Les Cables de Lyon, Cedex, France

[21] Appl. No.: 781,373

[22] Filed: Sep. 30, 1985

[30] Foreign Application Priority Data

Sep. 28, 1984 [FR] France ..... 84 14948

[51] Int. Cl.[4] ..... D07B 3/06; D07B 7/02

[52] U.S. Cl. ..... 57/264; 57/3; 57/13; 226/184

[58] Field of Search ..... 57/1, 3, 6, 9, 11, 13, 57/15, 17, 18, 58.83, 58.86, 264, 352; 226/183, 184, 186, 187

[56] References Cited

U.S. PATENT DOCUMENTS

| | | | |
|---|---|---|---|
| 749,752 | 1/1904 | Schoonmaker | 57/13 |
| 2,445,365 | 7/1948 | Reardon | 57/13 X |
| 2,802,328 | 8/1957 | Ritchie | 57/13 |
| 3,138,511 | 6/1964 | Cadwallader | 57/15 X |
| 3,196,656 | 7/1965 | Johnston | 226/184 X |
| 4,392,342 | 7/1983 | Meijer | 57/264 |
| 4,541,236 | 9/1985 | Dallolio | 57/264 |
| 4,549,391 | 10/1985 | Toda et al. | 57/13 |

FOREIGN PATENT DOCUMENTS

| | | |
|---|---|---|
| 394934 | 5/1924 | Fed. Rep. of Germany . |
| 745323 | 3/1944 | Fed. Rep. of Germany . |

*Primary Examiner*—Donald Watkins

*Attorney, Agent, or Firm*—Sughrue, Mion, Zinn, Macpeak & Seas

[57] ABSTRACT

A machine for winding, with a very short pitch, on a cable (1), at least one metal sheathing wire (5), comprising a first means for translatably moving a rectilinear portion of the cable in accordance with its axis and at least one coil (4) for distribution of said wire arranged on a coil-holder (3) subjected to turning around said cable in a perpendicular plane to said axis, with said wire passing on a grooved pulley (8) which is arranged between the coil and the cable and which has a fixed axis in relation to the coil, characterized in that the pulley (8) is provided with a driving means (9, 18, 20, 21, 22, 23) in rotation at an adjustable speed.

7 Claims, 2 Drawing Figures

MACHINE FOR WINDING ON A CABLE, WITH A VERY SHORT PITCH, AT LEAST ONE METAL SHEATHING WIRE

The present invention relates to a machine for winding, with a very short pitch, on a power or telecommunications cable, a plurality of armor wires.

Machines of this type are well known and consist essentially of means for translatably moving in accordance with its axis a rectilinear part of the cable, and at least one distribution coil for said wire subjected to turning around said rectilinear part of the cable in a perpendicular plane to said axis.

In this type of machine, the wire is unwound from the coil and driven by the traction exerted by the cable itself during its forward movement.

When the cable to be sheathed is fragile, for example when it is coated externally with a lead sheath, the above-described machine cannot be used. In effect, the effect of tightening metal wires (with a diameter of 6 to 7 mm or more) on the cable is considerable and would crush the lead. This would result in folds in the lead sheath which would create irregularities in insulation and could cause the cable to break down during use.

One object of the present invention is to produce a machine enabling the correct placing of the sheathing wires for a cable, without crushing the interior of the cable whilst maintaining good wire tension and a regular pitch of the helical sheathing.

The object of the invention is a machine for winding, with a very short pitch, on a cable, at least one metal sheathing wire, comprising a first means for translatably moving a rectilinear portion of the cable in accordance with its axis and at least one distribution coil of said wire on a coil-holder subjected to turning around the cable in a perpendicular plane to said axis, with the wire passing on a grooved pulley arranged between the coil and the cable which has a fixed axis in relation to the coil, wherein the pulley is provided with means for driving in rotation at an adjustable speed.

Preferably the pulley driving means comprises a drum which is coaxial to the coil-holder and is driven by a motor connected to a speed reducer, said drum bearing a cogged ring which is coaxial to the drum and which drives by means of a chain a gear with an axis connected to the coil-holder, said gear being rotatably connected to said pulley.

The invention will be clearly understood from the following description of a preferred embodiment of the invention, by reference to the attached drawings, in which.

Figure 1:
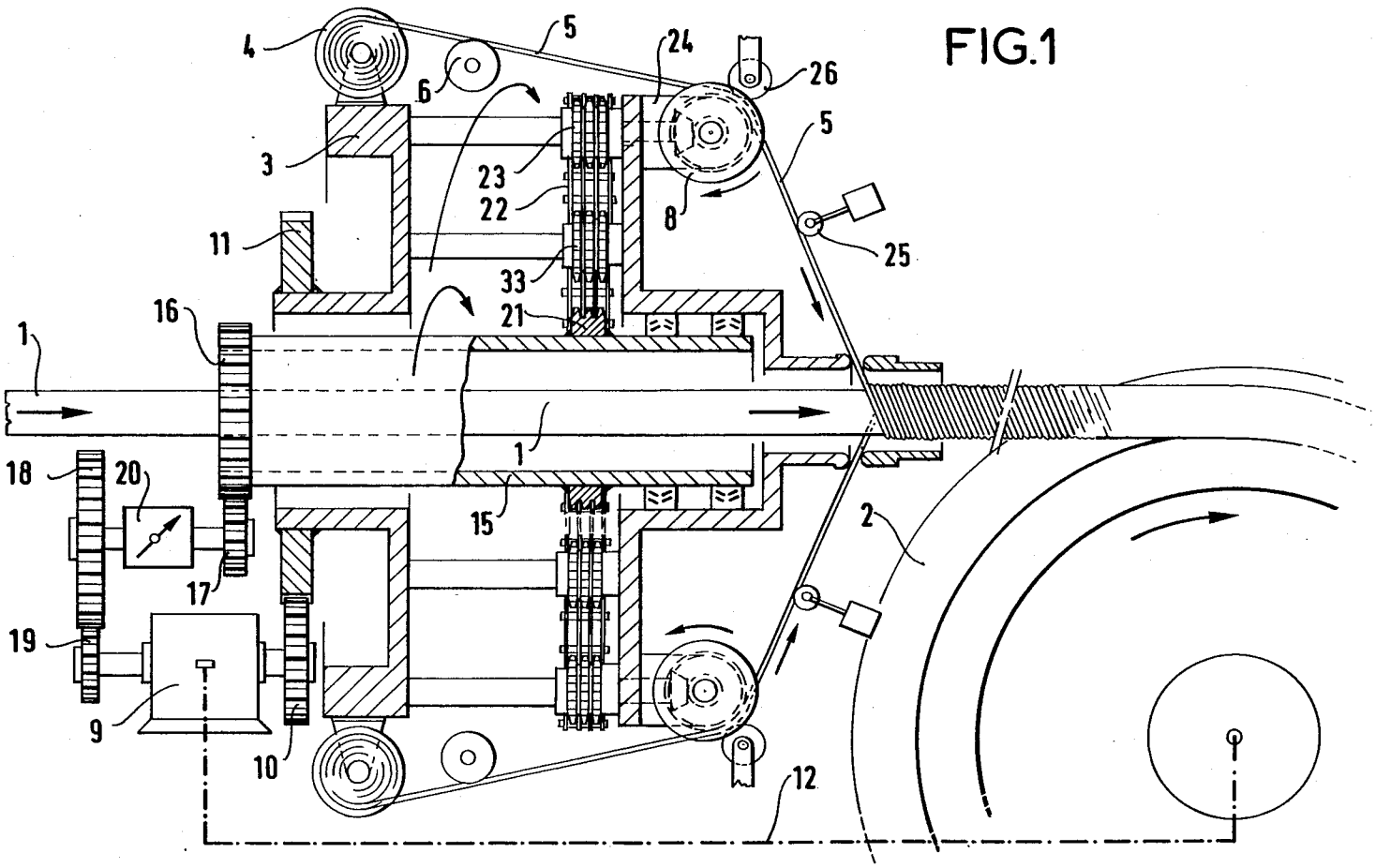
FIG. 1 is a schematic view of the principle of the invention.

In FIG. 1, the cable to be sheathed is designated by reference numeral 1. It is moved translatably in accordance with the direction of the arrow and, after having received the sheathing wires on a part which has been rendered rectilinear, it is wound on a winch 2 and then on a cable-drum which is not shown.

The winding of the metal sheathing wires is carried out, as is well known, by rotation, around the rectilinear part of the cable, of a coil-holder assembly 3. For clarity of the drawing, only two coil-holders 4 have been shown, but it must be understood that there are several coil-holders, for example sixteen, which are evenly distributed around assembly 3 to which they are fixed.

Wire 5 comes out of coil 4 and passes on pulleys 6 and 8. Assembly 3 is driven in rotation by a motor 9 which drives, by means of a gear 10, a cogged ring 11 which surrounds assembly 3.

The broken line 12 represents the synchronism between the movement of the winch 2, that is, the translation speed of the cable, and the rotation speed of the coil-holder assembly 3.

All that has been described above is well known in the prior art.

In order to prevent damaging the cable due to the tension of the wire 5, in accordance with the invention one of the pulleys on which the wire passes in its path between the coil and the cable is motorized.

Preferably, pulley 8, which is located at the end of the assembly 3 from which the cable exits, is selected.

The pulley is driven by means of a drum 15, which is coaxial to the rectilinear part of the cable and inside the coil-holder assembly 3. This drum is driven in rotation by the motor 9 by a cogged ring 16, which cooperates with gears 17, 18 and 19. A speed varying means 20 is inserted between the gears 17 and 18. Its role will be explained below.

A cogged ring 21, at the cable-drum end of drum 15, provides the driving of pulley 8 by means of a chain 22, a gear 23 and an angle gear 24. The chain connection between the ring 21 and the gear 23 will be explained below by reference to FIG. 2.

The operation is the following:

During the winding of a wire the cable moves in translation and the coil-holder assembly in rotation, which provides even winding.

The rotation of pulley 8, in synchronism with the coil-holder, ensures the movement of the wire through friction, such that the tension on the cable is acceptable to it. This wire tension is measured by means of a sensor 25. If the tension of the wire is noticed to be too great, the speed varying means 20 is activated in order to increase the angular speed of the drum and therefore that of pulley 8.

If, on the other hand, the cable is insufficiently taut, the drum speed is reduced.

A presser roller 26 maintains wire 6 in the groove of pulley 8; this groove, which has a triangular profile, provides a friction and, therefore, a more or less strong drive of the wire depending on whether it goes faster or slower in relation to the correct speed. There is therefore "self-adjustment".

Figure 2:
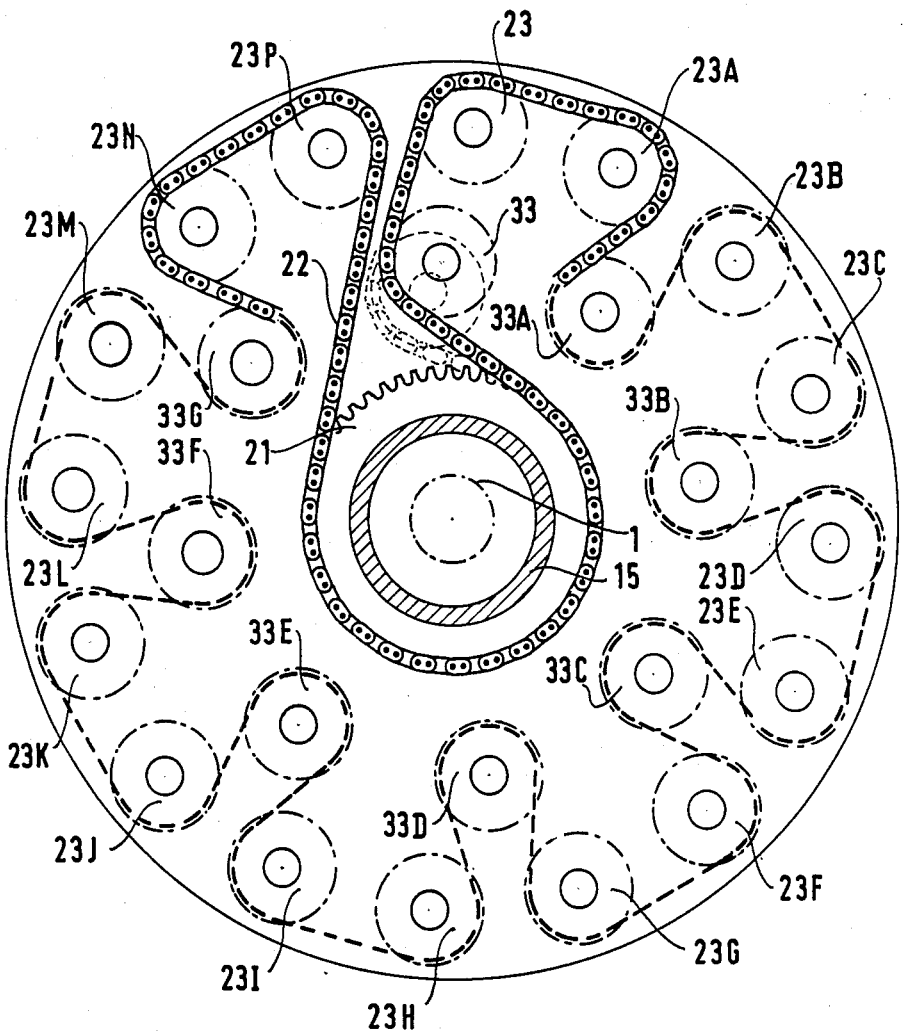
FIG. 2 is a schematic view showing the simultaneous driving of 16 pulleys on a same machine.

The machine is fitted with as many cogged ring 23, angle gear 24 and motorized pulley 8 assemblies as there are coils 4. Preferably a single drive chain 22 is used, as is shown in FIG. 2 which is a partial end view of a machine with sixteen coil-holders.

On it can be seen cable 1 passing into drum 15 which bears the cogged gear 22. Chain 22 passes on the gears 23 and its homologs 23A, 23B, 23C, . . . , 23N, 23P corresponding to the 15 other wire-driving assemblies.

Cogged wheels 33, 33A, 33B, . . . , 33G act as gears for chain 22; at least one of said wheels, wheel 33 in this case, has a movable shaft so as to enable adjustment of the tension of the chain (the broken lines shown another position of the chain and the wheel 33). In an elaborated version, which is not limitative in accordance with the invention, the indications of the wire tension sensor 25 can directly control the ratio of the speed varying means 20 or the speed of the control motor if said motor is independent of the principal motor 9.

What is claimed is:

1. In a machine for winding, with a very short pitch, on a cable (1), at least one metal sheathing wire (5), comprising a coil holder (3) holding a coil of said sheathing wire (5), a grooved pulley rotatably mounted on said coil holder for rotation about the pulley axis, a first means for translatably moving a rectilinear portion of the cable along its axis and at least one coil (4) for distribution of said wire arranged on said coil-holder (3), means for rotating said coil holder around the said cable in a plane perpendicular to said cable axis, with said wire passing on said grooved pulley (8), said pulley (8) being arranged between the coil and the cable and having a fixed axis in relation to the coil, the improvement comprising means (9, 18, 20, 21, 22, 23) for independently driving and controlling the speed of said pulley (8).

2. The machine in accordance with claim 1, characterized in that the pulley (8) has a triangular groove.

3. The machine in accordance with one of claims 1 and 2, characterized in that a presser component (26) exerts pressure on the wire in order to retain it at the bottom of the groove.

4. The machine in accordance with claim 1, wherein said drive means for said pulley (8) comprises a drum (15), which is coaxial to the coil-holder, a motor (10), a speed reducer (20) connected to said motor and driven thereby, said speed reducer being coupled to said drum for driving said drum, said drum bearing a cogged ring (21) which is coaxial to the drum, a first gear 23 mounted for rotation about its axis on the coil-holder (3), and means for drivably connecting said first gear to said pulley, and a chain (22) operatively connecting said cogged ring (21) and said first gear (23).

5. The machine in accordance with claim 4, wherein said means for drivably connecting said first gear and said pulley comprises a bevel gear fixed to said first gear and engaging said pulley.

6. The machine in accordance with claim 1, wherein a presser roller (26) presses the wire in the groove of the pulley (8).

7. The machine in accordance with claim 1, wherein said means for controlling said speed of said pulley comprises a sensor (25) measuring the tension of the wire exiting from the pulley (8).

* * * * *